US009249600B2

(12) United States Patent
Oliana

(10) Patent No.: US 9,249,600 B2
(45) Date of Patent: Feb. 2, 2016

(54) LOCK FOR A DOOR OR DOOR WING

(71) Applicant: Pier Luigi Oliana, Conegliano (IT)

(72) Inventor: Pier Luigi Oliana, Conegliano (IT)

( * ) Notice: Subject to any disclaimer, the term of this patent is extended or adjusted under 35 U.S.C. 154(b) by 0 days.

(21) Appl. No.: 14/179,617

(22) Filed: Feb. 13, 2014

(65) Prior Publication Data

US 2014/0230500 A1 Aug. 21, 2014

(30) Foreign Application Priority Data

Feb. 15, 2013 (IT) ..... TV2013A0018

(51) Int. Cl.

| | |
|---|---|
| ***E05B 19/26*** | (2006.01) |
| ***E05B 15/14*** | (2006.01) |
| ***E05B 47/00*** | (2006.01) |
| ***E05B 63/00*** | (2006.01) |
| ***E05C 3/04*** | (2006.01) |

(52) U.S. Cl.

CPC ..... *E05B 15/14* (2013.01); *E05B 47/0042* (2013.01); *E05B 63/0065* (2013.01); *E05C 3/042* (2013.01); *Y10T 70/7486* (2015.04)

(58) Field of Classification Search

CPC ..... E05B 47/0042; E05B 63/0065; E05B 47/0043; E05B 47/0045; E05B 47/0038; E05B 15/0073; E05B 15/14; E05C 3/042

USPC ..... 70/78, 79, 81, 135, 136, 139, 276, 413, 70/416, 417, 423, 427, 453, 454, 455, 344

See application file for complete search history.

(56) References Cited

U.S. PATENT DOCUMENTS

| | | | | | |
|---|---|---|---|---|---|
| 3,509,748 | A * | 5/1970 | Trainor | ..... | 70/491 |
| 3,602,020 | A * | 8/1971 | Kajita | ..... | 70/276 |
| 3,779,052 | A * | 12/1973 | Deitch | ..... | 70/38 C |
| 3,782,147 | A * | 1/1974 | Hallmann | ..... | 70/276 |
| 3,903,720 | A * | 9/1975 | Scherbing | ..... | 70/491 |
| 3,967,479 | A * | 7/1976 | Vick | ..... | 70/276 |
| 3,995,460 | A * | 12/1976 | Sedley | ..... | 70/210 |
| 4,022,038 | A * | 5/1977 | Miller | ..... | 70/276 |
| 4,285,220 | A * | 8/1981 | Kajita | ..... | 70/276 |
| 4,307,589 | A * | 12/1981 | Kajita | ..... | 70/276 |
| 5,839,307 | A * | 11/1998 | Field et al. | ..... | 70/283 |
| 8,800,332 | B2 * | 8/2014 | Oliana | ..... | 70/276 |
| 2004/0231377 | A1 * | 11/2004 | Sedley | ..... | 70/276 |
| 2005/0257584 | A1 | 11/2005 | Tseng | | |
| 2009/0293563 | A1 * | 12/2009 | Jeng | ..... | 70/359 |

FOREIGN PATENT DOCUMENTS

| | | | |
|---|---|---|---|
| EP | 2 525 023 | A1 | 11/2012 |
| FR | 2 791 379 | A1 | 9/2000 |

OTHER PUBLICATIONS

Italian Search Report from corresponding IT Application No. TV20130018 dated Nov. 7, 2013.

* cited by examiner

*Primary Examiner* — Christopher Boswell
*Assistant Examiner* — Amanda L Miller
(74) *Attorney, Agent, or Firm* — Lando & Anastasi LLP

(57) ABSTRACT

A lock includes a cylinder, fixed to a door or door wing, with which a pivot is associated coaxially and rotatably, a lever for closing the door or door wing to a jamb being keyed to the end of the pivot; a separate body can be keyed detachably to the head of the pivot and is provided with magnetic elements for the temporary locking of the rotation of the body with respect to the cylinder.

13 Claims, 13 Drawing Sheets

LOCK FOR A DOOR OR DOOR WING

CROSS-REFERENCE TO RELATED APPLICATION

This application claims priority under 35 U.S.C. §119(a)-(d) to Italian Patent Application No. TV2013A000018, filed on Feb. 15, 2013, which is hereby incorporated by reference in its entirety for all purposes.

BACKGROUND OF THE INVENTION

The present invention relates to a lock.

Currently, locks, also termed cam locks, are known which are substantially constituted by a cam or plate made of metal, fixed to a pivot, which rotates together with the key; the metal plate usually moves by 90° or 180° and makes it possible to ensure the locking for example of a door; these locks can use cylindrical pin tumblers of different lengths arranged in a circle and moved into position by a tubular key, or are provided with a row of discs with different profiles, which must be aligned by the correct key in order to open the lock, and in this case the key used is of the flat type.

This known type of lock is structurally very simple and therefore is subject to break-ins.

As a partial solution to this drawback, for example, the "Series 35" lock by the British company CAMLOCK SYSTEM Ltd, headquartered in 3 Park View, Compton Industrial Estate, Eastbourne, East Sussex, is known which comprises a cylinder provided with an anti-drill center post to which said lever is keyed and which can be activated by means of an adapted key provided with radial elements that can be inserted in complementary shaped seats or slots provided in a cover that can be screwed onto said cylinder.

These known types of locks have another drawback, which is linked to the great diversity of dimensions of the cylinders that can be used, which makes it necessary to have many items in stock.

SUMMARY OF THE INVENTION

The aim of the present invention is to solve the highlighted technical problems, eliminating the drawbacks of the cited background art, by devising a lock of the cam type that allows the hindering of tampering attempts and has low manufacturing, stocking and transport costs.

Within this aim, an object of the invention is to provide a lock that makes it possible to prevent a burglar from achieving a condition of direct access to the cylinder.

Another object is to provide a lock that is structurally simple and has low manufacturing costs.

This aim and these and other objects that will become more apparent hereinafter are achieved by a lock comprising a cylinder, fixed to a door or door wing, with which a pivot is associated coaxially and rotatably, a lever for closing said door or door wing to a jamb being keyed to the end of said pivot, characterized in that a separate body can be keyed detachably to the head of said pivot and is provided with magnetic means for the temporary locking of the rotation of said body with respect to said cylinder.

BRIEF DESCRIPTION OF THE DRAWINGS

Further characteristics and advantages of the invention will become more apparent from the detailed description of a particular but not exclusive embodiment, illustrated by way of non-limiting example in the accompanying drawings, wherein.

Figure 1:
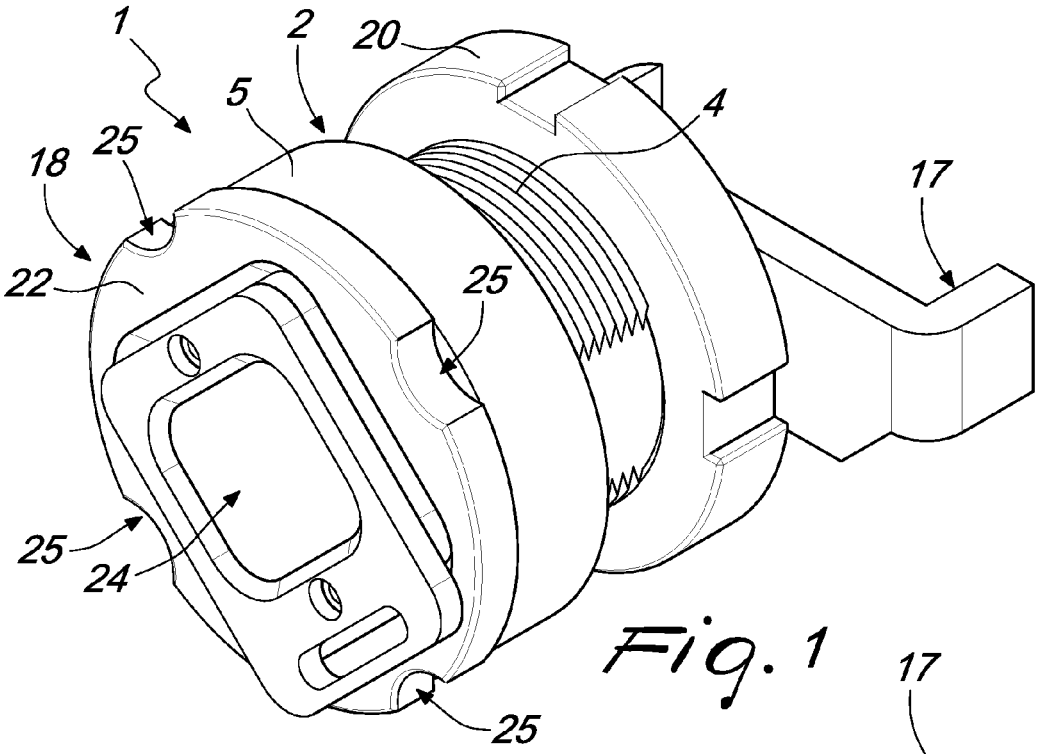
FIG. 1 is a lateral perspective view of the lock in a first position.
Figure 2:
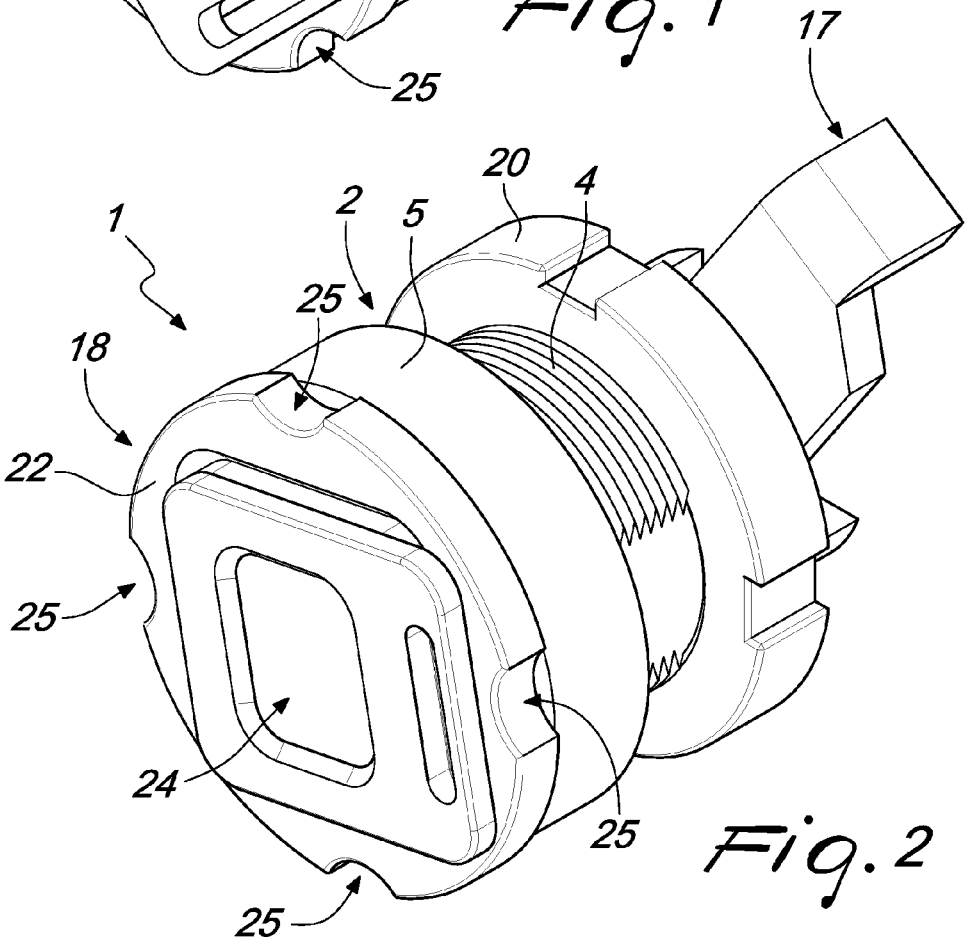
FIG. 2 is a lateral perspective view of the lock in a second position.
Figure 3:
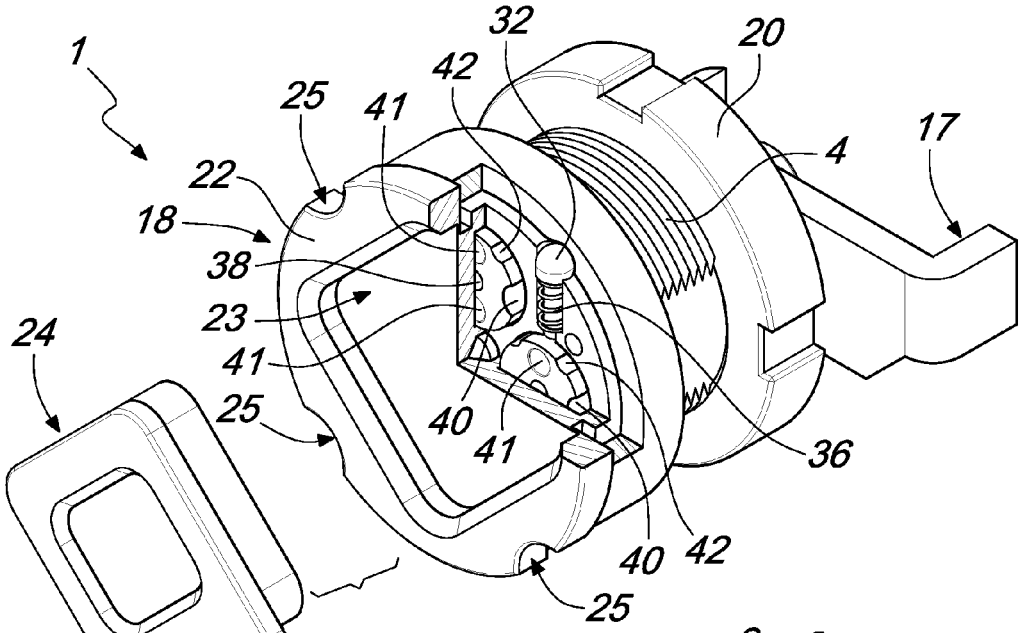
FIGS. 3 and 4 are respectively a partially sectional perspective view and a partially exploded view of the lock.
Figure 4:
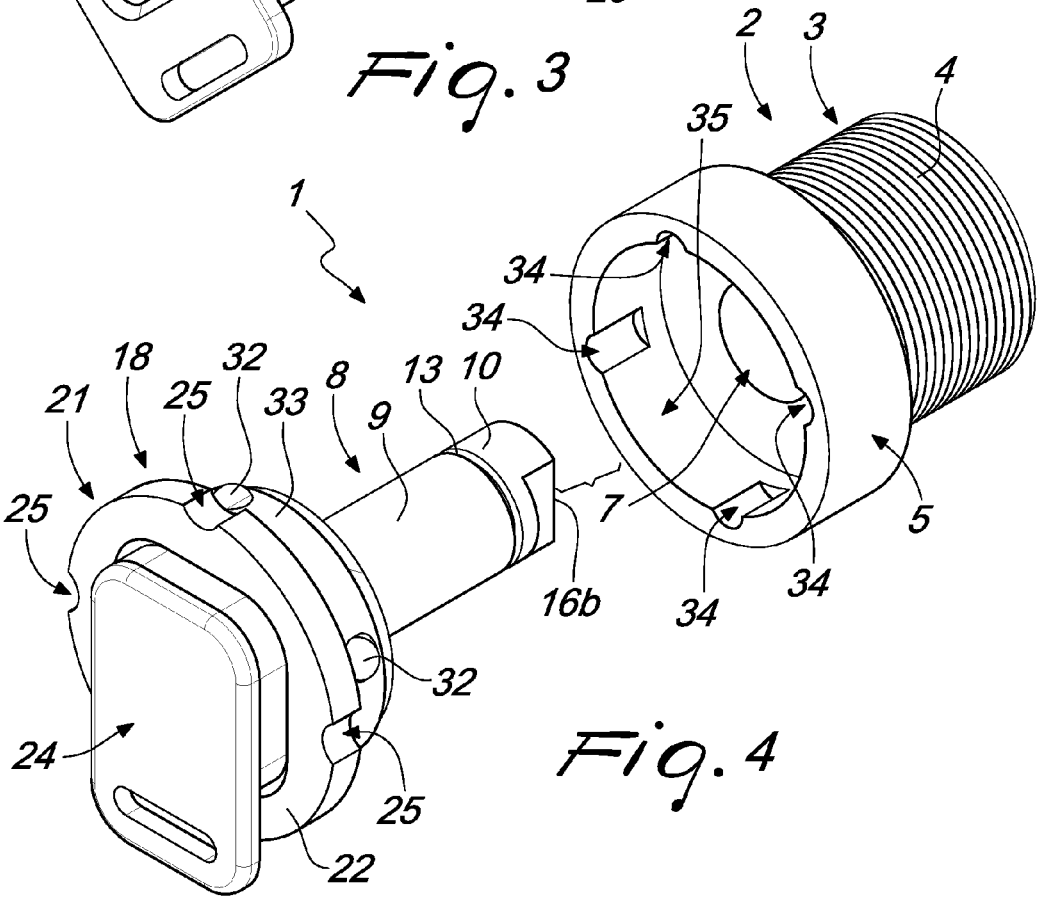
Figure 5:
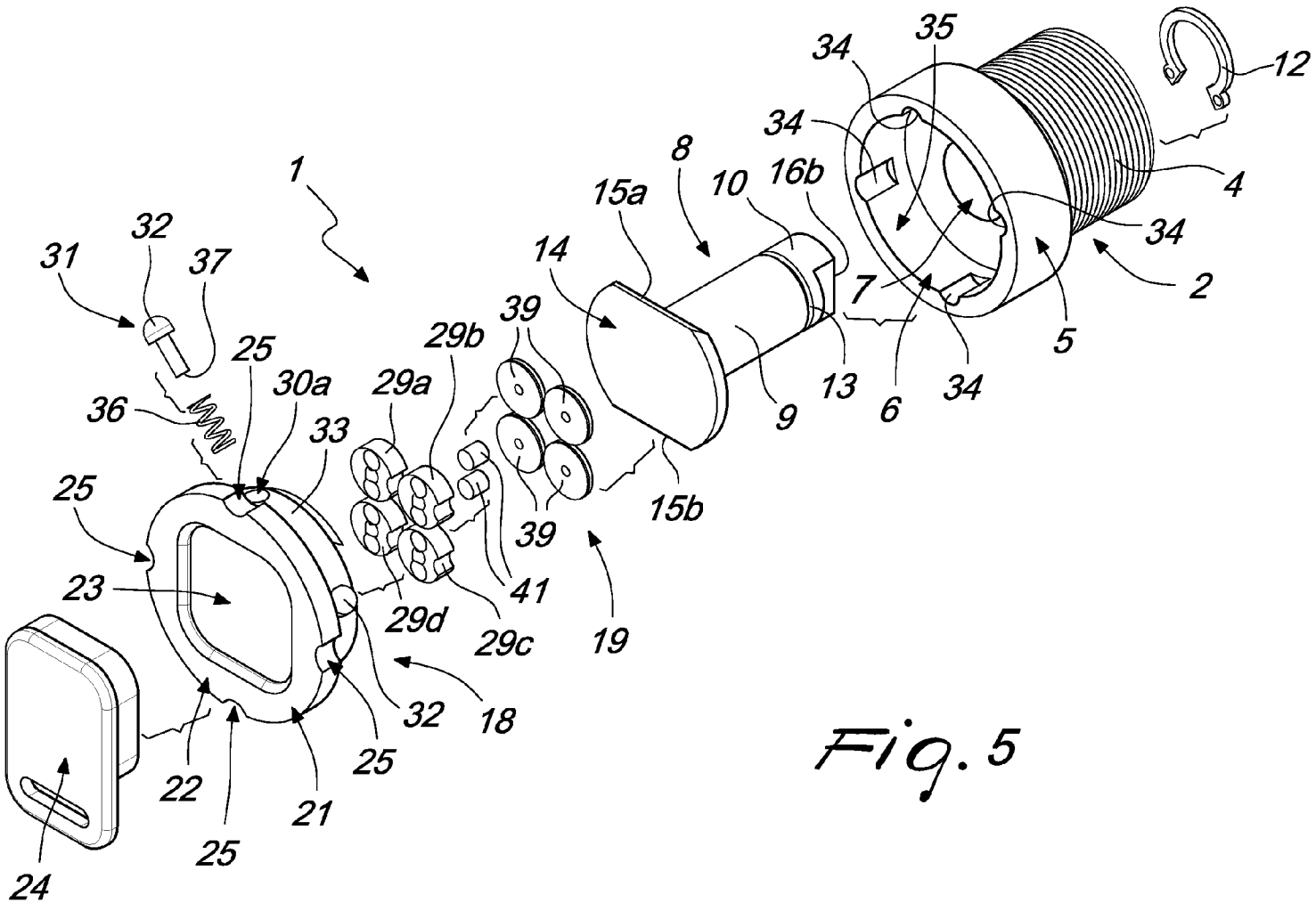
FIGS. 5 and 6 are two exploded views of the lock.
Figure 6:
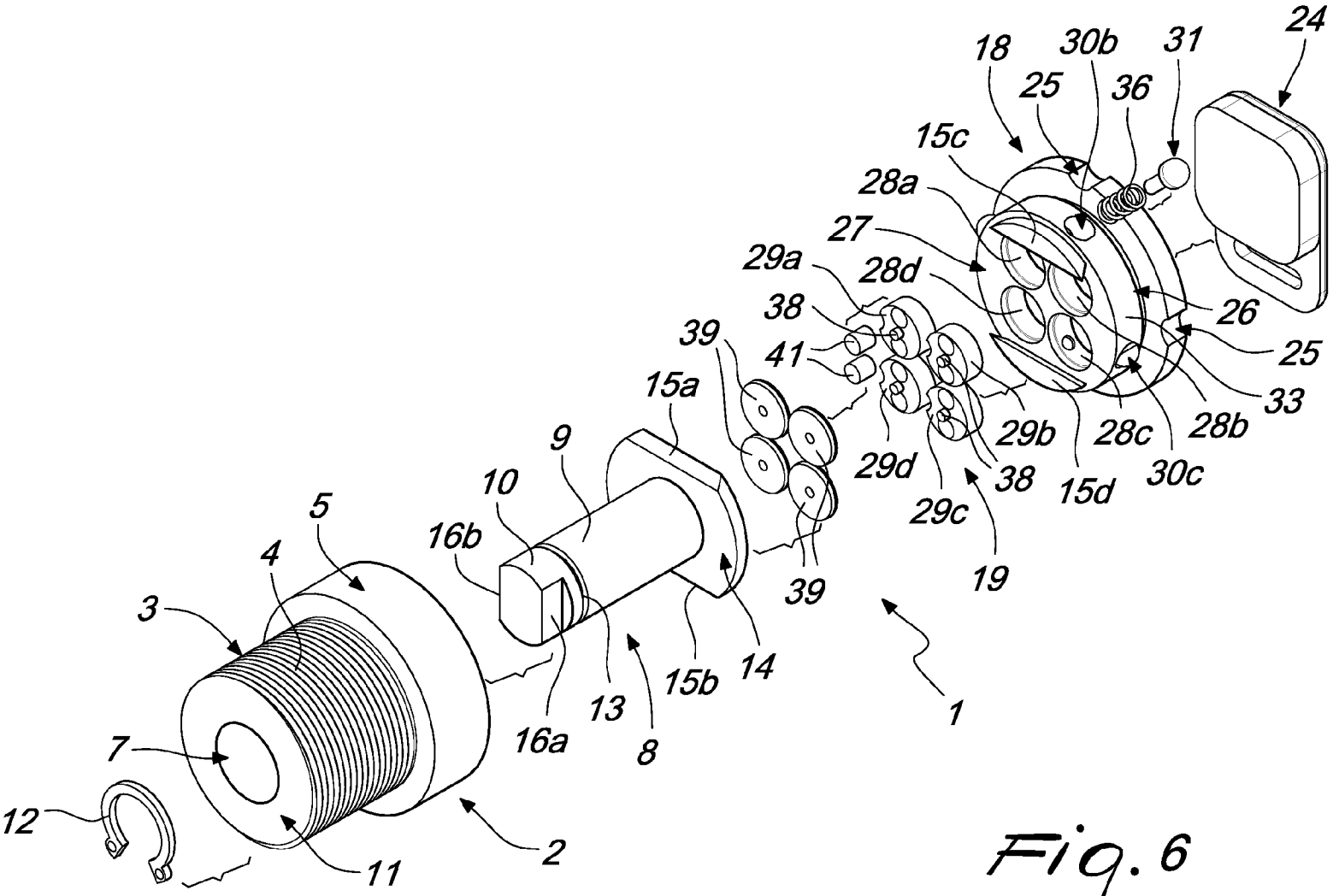

In the exemplary embodiments that follow, individual characteristics, given in relation to specific examples, may actually be interchanged with other different characteristics that exist in other exemplary embodiments.

DESCRIPTION OF THE PREFERRED EMBODIMENTS

With reference to the accompanying figures, the reference numeral 1 designates a lock, which comprises a cylinder 2, fixed to a door or door wing (not shown), which has a T-shaped configuration whose first stem 3 has an external thread 4 and whose first head 5 has a cylindrical shape and a first seat 6, axially to which a through hole 7 is provided.

A pivot 8 is arranged rotatably and coaxially in the first seat 6 and at the hole 7, such pivot 8 being T-shaped so as to form a second cylindrical stem 9, which acts rotatably in said hole 7 and which, when installed, protrudes with its end 10 beyond the lower surface 11 of the first stem 3 of the cylinder 2.

The second stem 9 is kept rotatably associated, without the possibility of disconnection, with the cylinder 2 by means of an elastic key 12, which is omega-shaped and can be associated at an annular groove 13 that is provided in said first stem 9 and is adjacent to said end 10.

The pivot 8 has, moreover, a second flat head 14, which acts rotatably within the first seat 6, the second head 14 having, in plain view, a circular shape with two recesses 15*a*, 15*b* obtained along two parallel chords.

A lever 17 is keyed to the end 10 of the second stem 9, which has an adapted pair of mutually parallel bevels 16*a*, 16*b* and is adapted to allow the closing of said door or door wing to a jamb.

A separate body 18 can be keyed detachably at said second head 14 of said pivot 8 and is provided with magnetic means 19 for the temporary locking of the rotation of said body 18 with respect to said cylinder 2.

The cylinder 2 is fixed to a door or door wing by means of an adapted ring 20 that can be associated rotatably with said external thread 4 of the first stem 3 of said cylinder 2.

The body 18 is constituted by a disc 21 that has, on a front surface 22 that is directed away from the cylinder 2, a second seat 23, which has a preferably square plan shape with rounded corners and within which it is possible to arrange selectively a complementary shaped magnetic key 24 that contains at least one magnet. Grooves 25 are provided in the perimetric edge of the disc 21 and are adapted to constitute grip means for the user, who can thus impart a desired rotation to the disc 21.

A third cylindrical stem 26 protrudes on the side that is opposite to the front surface 22 of the disc 21 and has, in its surface 27 directed toward the pivot 8, in the particular embodiment shown, four circular third seats or cavities 28*a*, 28*b*, 28*c*, 28*d* for complementary shaped cams 29*a*, 29*b*, 29*c*, 29*d*, that can be associated rotatably therewith.

Figure 7:
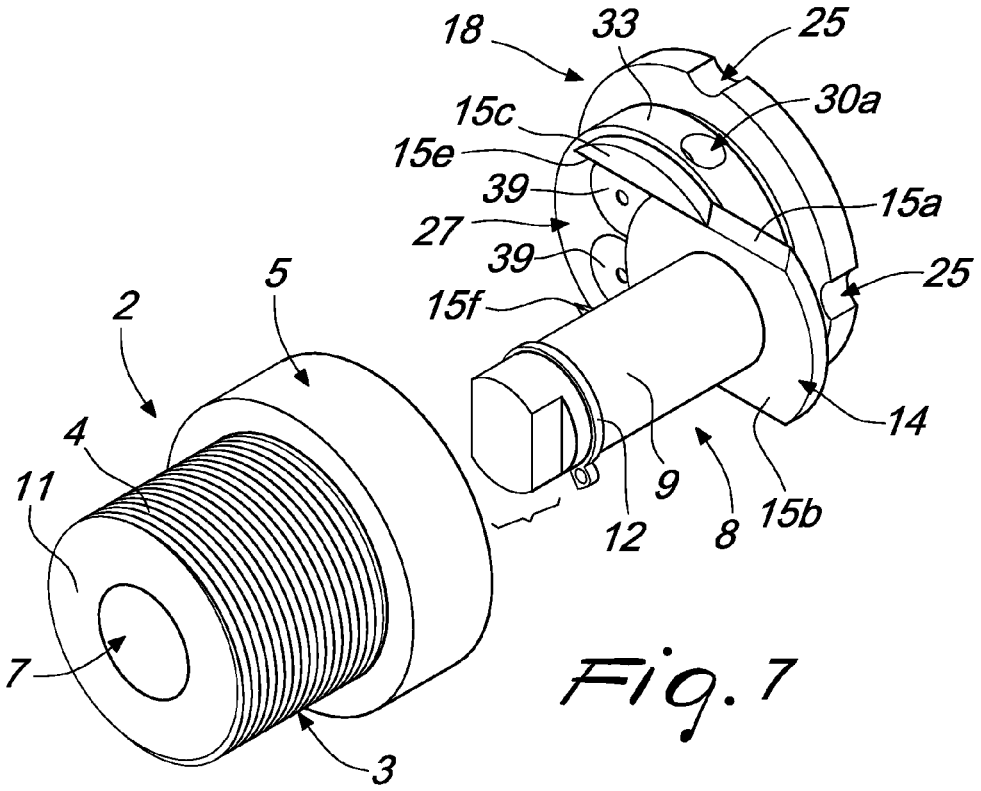
FIGS. 7 and 8 are two views of parts of the partially disassembled invention.
Figure 8:
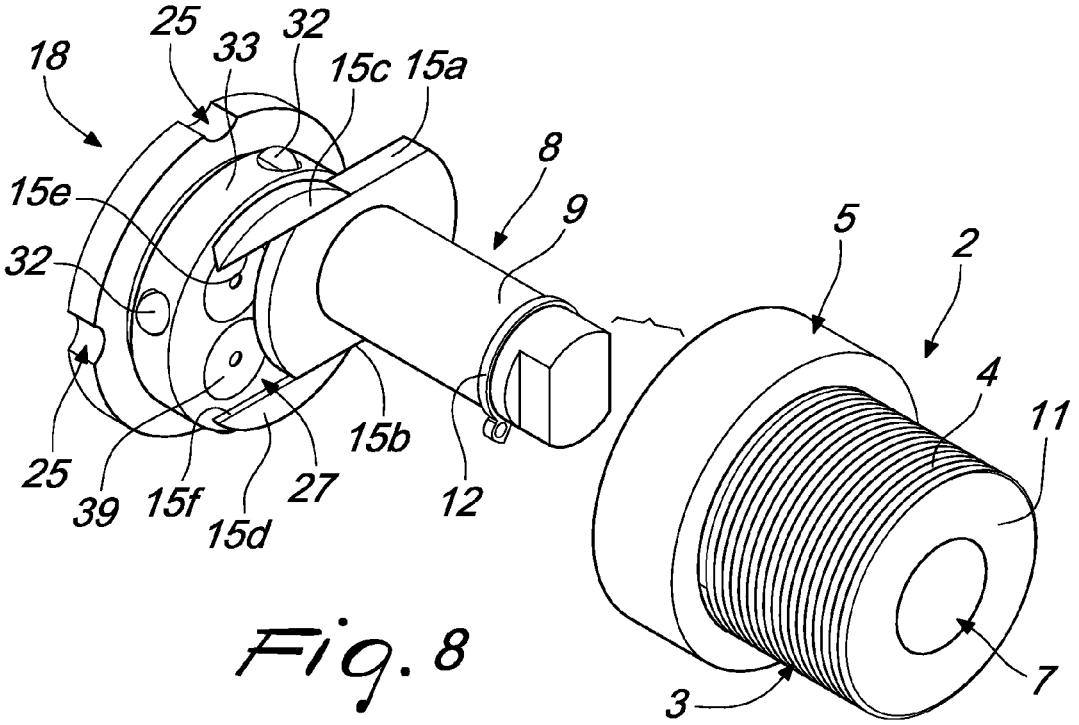
Figure 9:
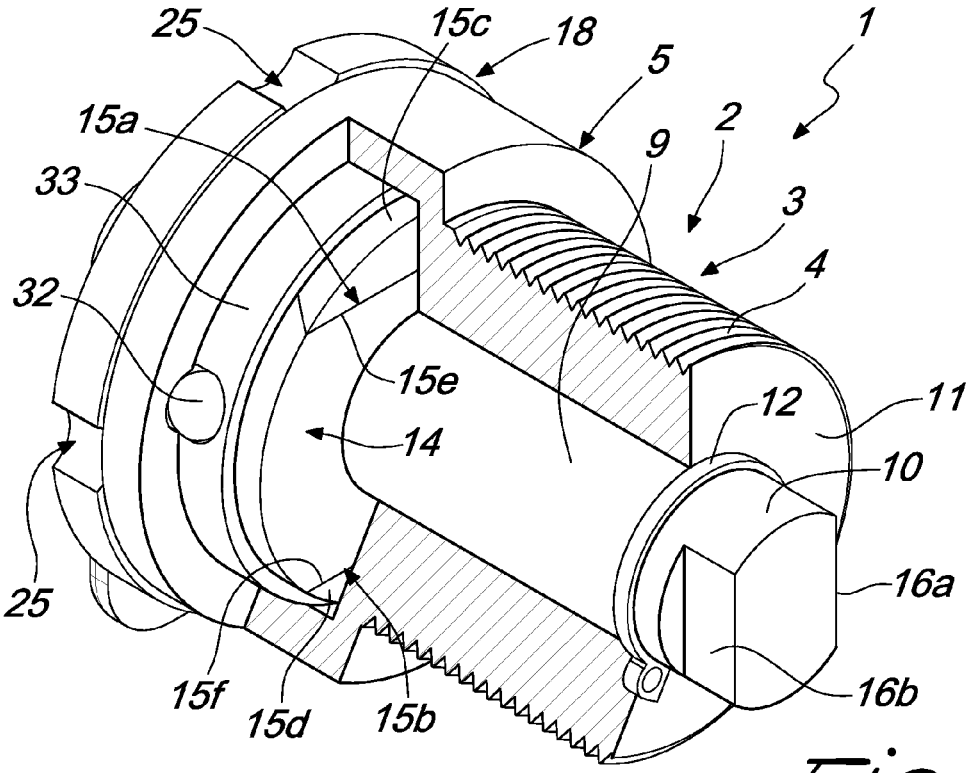
FIGS. 9 and 10 are two partially sectional perspective views of the invention.
Figure 10:
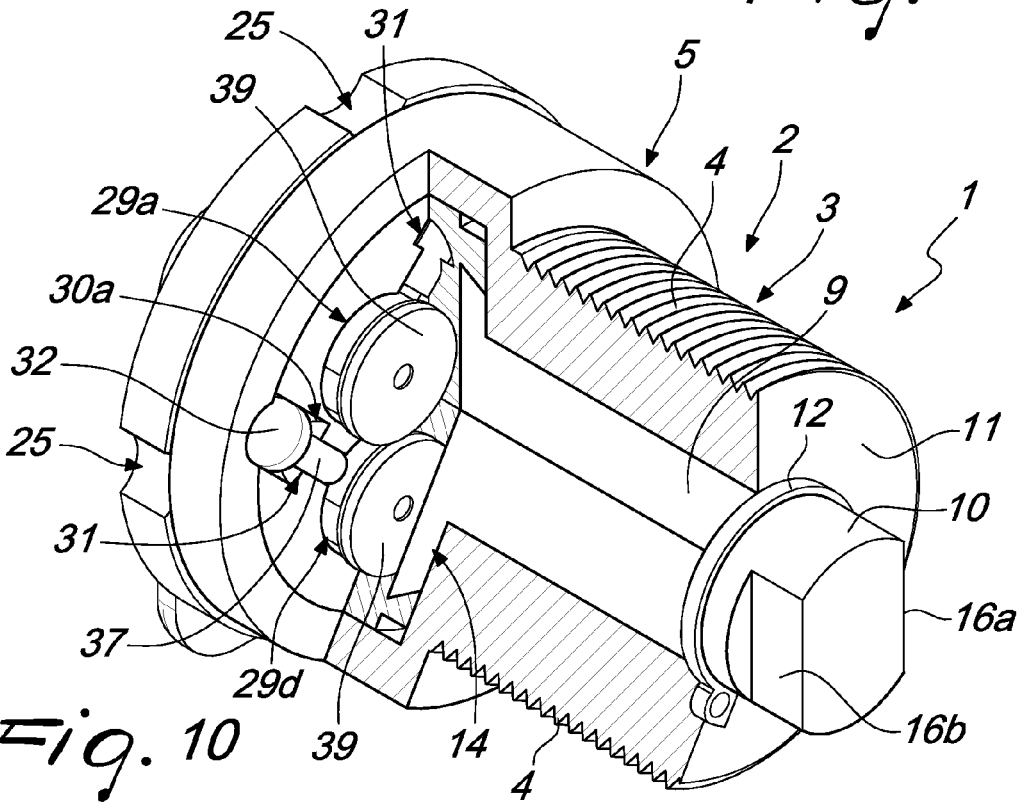
Figure 11:
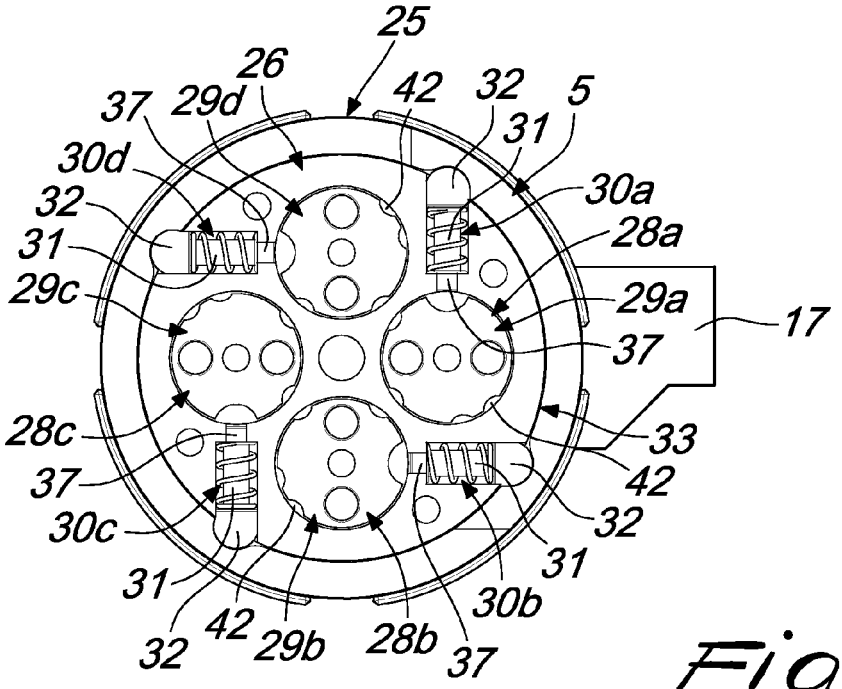
FIGS. 11 to 13 are views of the invention that highlight the magnetic means and their interaction with the cylinder.
Figure 12:
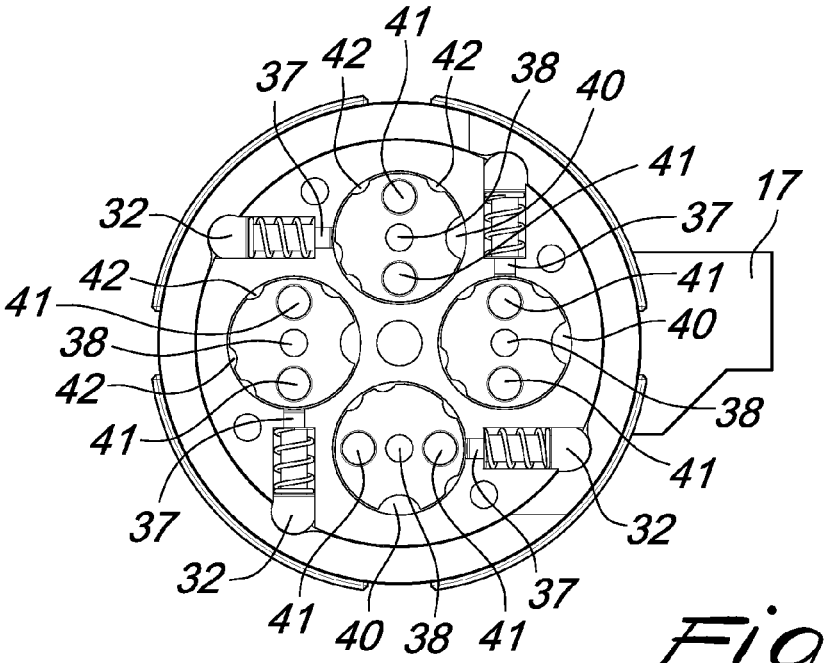
Figure 13:
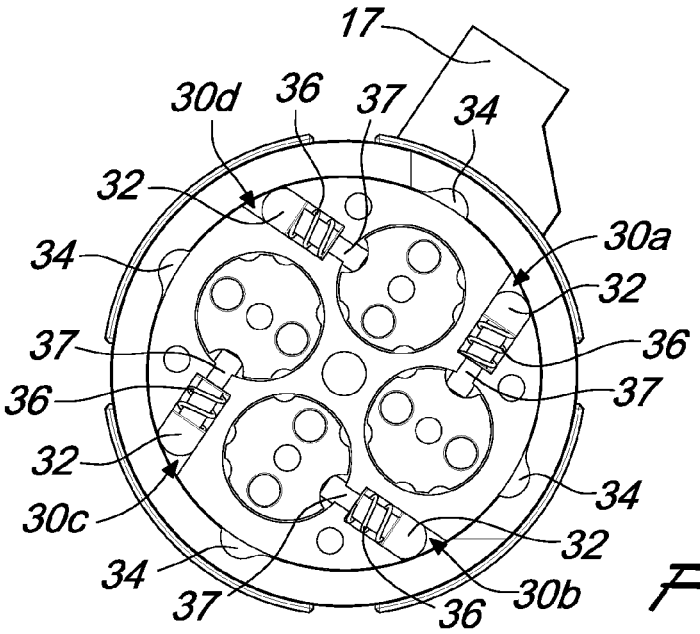
Figure 14:
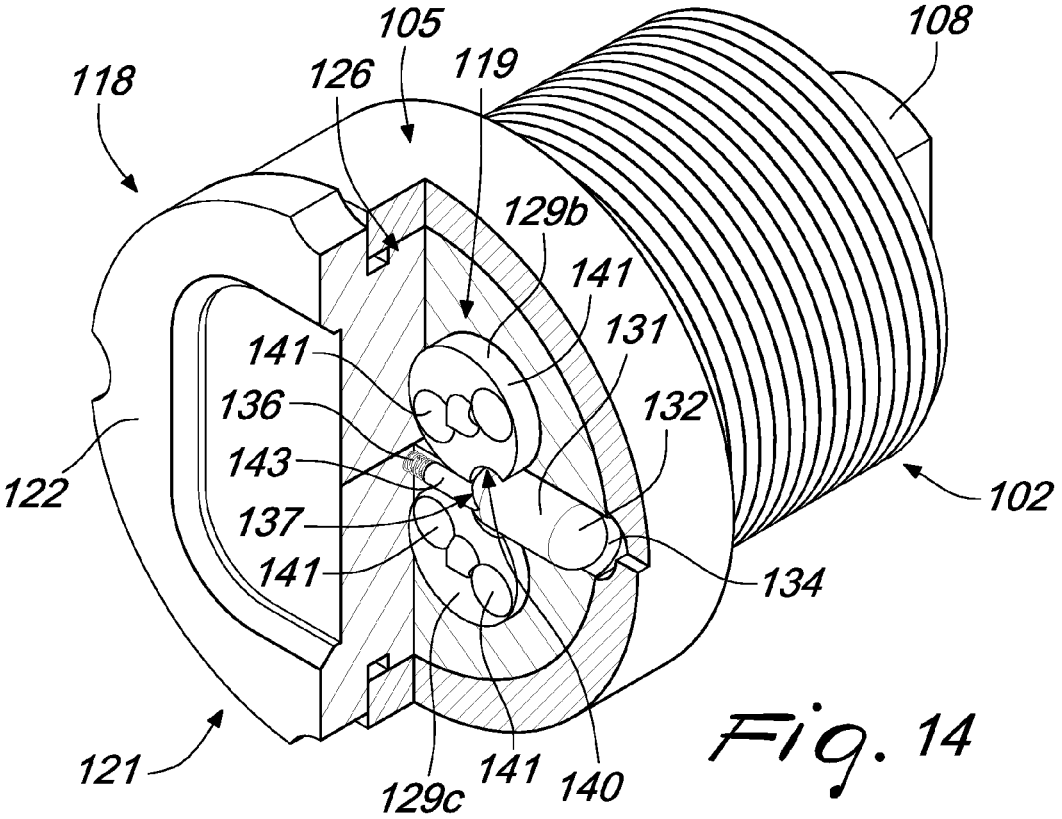
FIGS. 14, 15, 17 and 18 are first and second lateral perspective views of a further embodiment in the conditions of activation and deactivation of the magnetic means.
Figure 15:
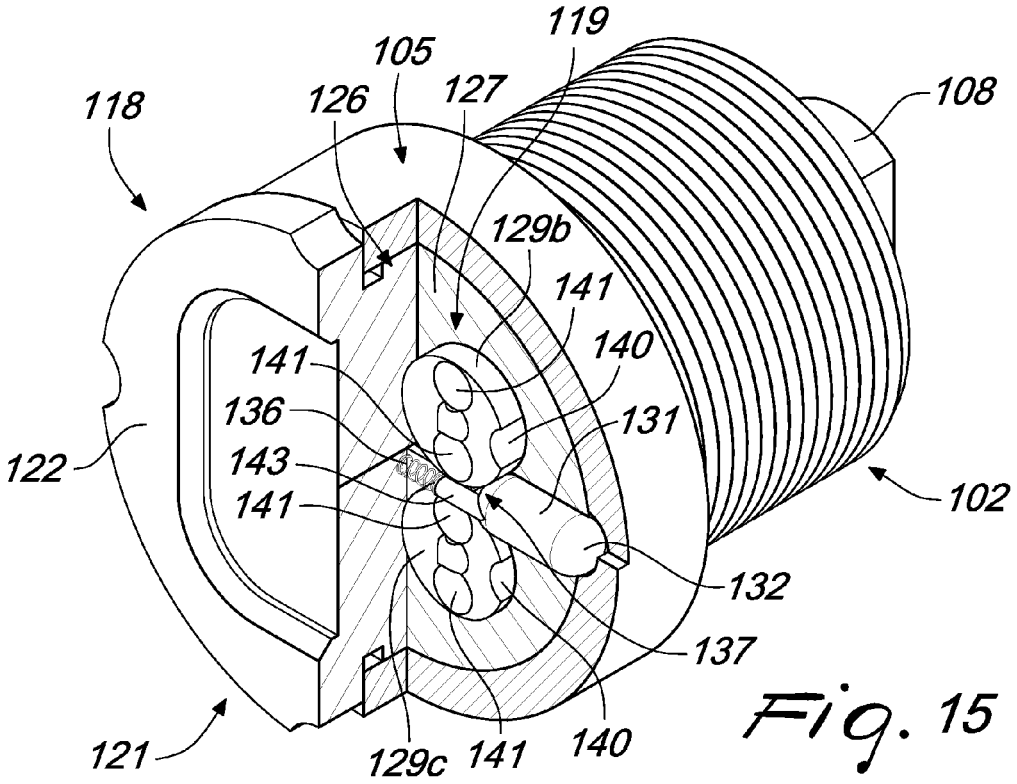
Figure 16:
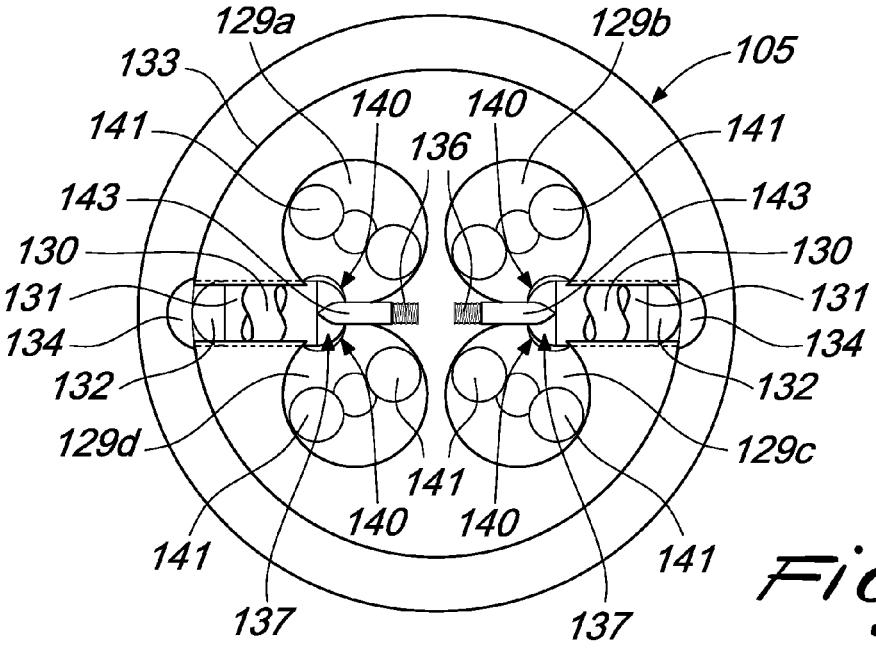
FIG. 16 is a front view of the activation condition of the magnetic means.
Figure 17:
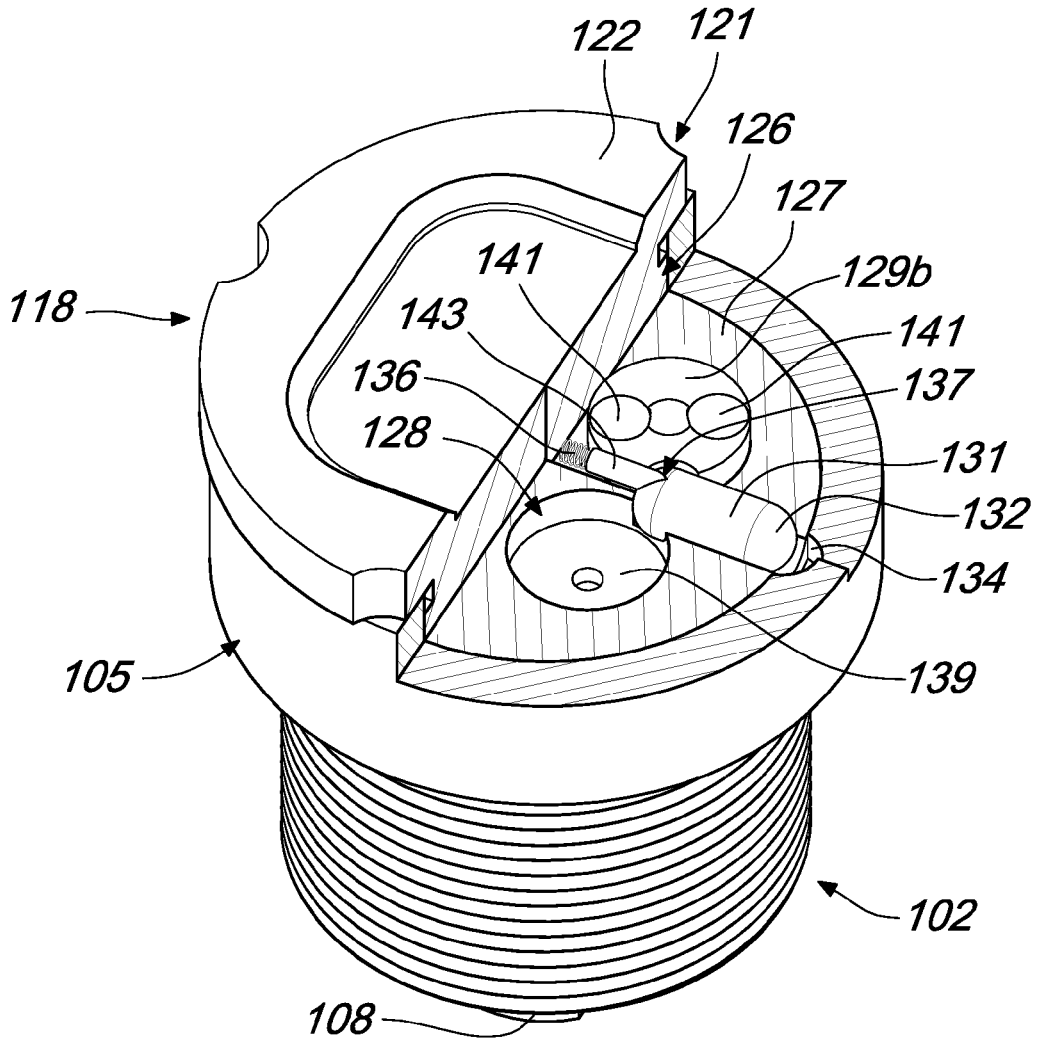
Figure 18:
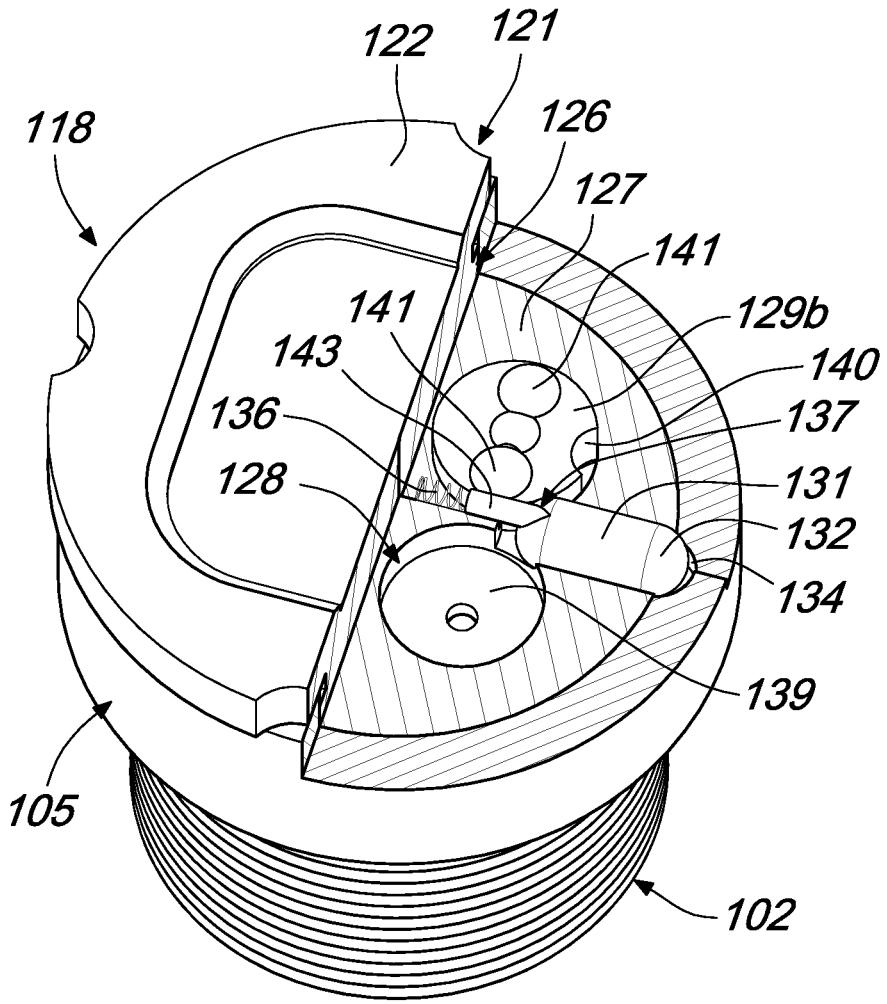
Figure 19:
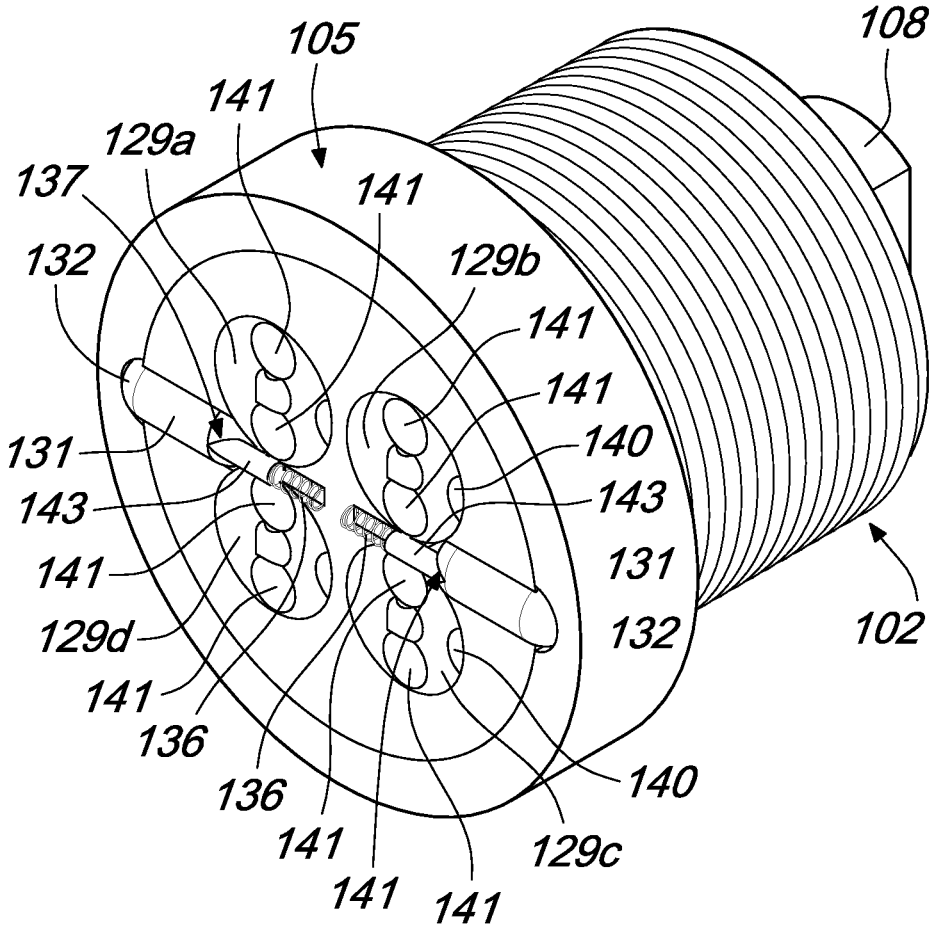
FIGS. 19 and 20 are lateral and front perspective views of the deactivation condition of the magnetic means.
Figure 20:
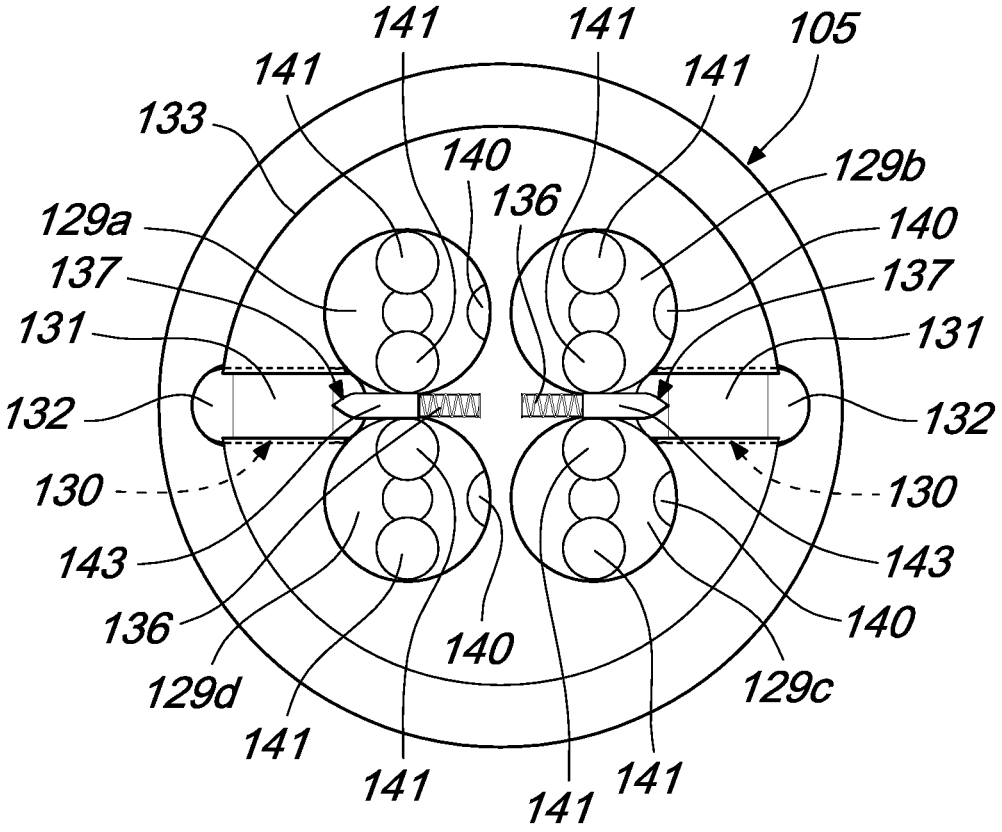

The body 18 can be associated slidingly and detachably with the second head 14 and has, for this purpose, an adapted pair of protrusions 15*c*, 15*d*, which are preferably crescent-shaped, protrude so as to be mutually opposite from the surface 27, and have such dimensions and such an arrangement that they interact slidingly with the recesses 15*a*, 15*b*, as shown in FIGS. 7 and 8, so as to achieve temporary interconnection with the second head 14.

The height of the flat base 15*e*, 15*f* of the protrusions 15*c*, 15*d* in fact is substantially equal to the width of the recesses 15*a*, 15*b*, while the distance between the protrusions 15*c*, 15*d* is substantially equal to the distance between the recesses 15*a*, 15*b*.

Advantageously, the coupling occurs by means of a dovetail connection, the surfaces of the recesses 15*a*, 15*b* and of the protrusions 15*c*, 15*d* being inclined.

The third seats or cavities are advantageously arranged with the center at the corners of a polygon, constituted, in the particular embodiment, by a square.

As an alternative, the number of the four third seats or cavities may be larger or smaller than four; advantageously, the center of the four third seats or cavities is arranged at a polygon having an equal number of sides; thus, if there are three seats the polygon will be a triangle, if there are five it will be a pentagon, and so forth.

Four through openings 30*a*, 30*b*, 30*c*, 30*d* are provided at the third stem 26 along chords that pass through a diameter of each one of said third seats or cavities 28*a*, 28*b*, 28*c*, 28*d* and are connected thereto, and are oriented so as to be arranged, in a clockwise sequence, at right angles to each other and in mutually opposite pairs, each one affecting the diameter of the respective third seat or cavity that is distinct from the one of the third stem 26.

A pin 31 is arrangeable within each one of said through openings 30*a*, 30*b*, 30*c*, 30*d* and has advantageously an approximately hemispherical head.

These pins 31 are slightly longer than the depth of the respective through openings 30*a*, 30*b*, 30*c*, 30*d* and have the function of locking temporarily, when they protrude with their first end 32 beyond the perimetric edge 33 of the third stem 26, the rotation of said cylinder 2, since the first ends are arranged temporarily within adapted fourth seats 34 that are provided axially to the internal lateral surface 35 of the first head 5 of the cylinder 2.

Each one of the through openings 30*a*, 30*b*, 30*c*, 30*d* has an end section, directed away from the cylinder 5, that is narrow, so as to form a discontinuity that is adapted to act as an abutment for an end of an elastically deformable element, such as a spring 36, which with the opposite end abuts against the base of the first end 32 of the pins 31.

The springs 36 force the first end 32 of the pins 31 to protrude from the through openings 30*a*, 30*b*, 30*c*, 30*d* in order to allow the first ends 32 to be arranged, when they are in front of them, in fourth seats 34 of the cylinder 2.

Each one of the pins 31 has, at the end opposite to the first end 32, a second end 37, which, in the condition in which the first ends 32 are arranged within the fourth seats 34 of the cylinder 2, is completely inserted in one of the through openings 30*a*, 30*b*, 30*c*, 30*d*, without therefore protruding from them.

The length of the pins is therefore such that either the first end 32 or the second end 37 protrudes out of the through openings 30*a*, 30*b*, 30*c*, 30*d*.

The cams 29*a*, 29*b*, 29*c*, 29*d* are kept in position by means of adapted central axes or pivots 38 that protrude from them and are supported by adapted discs 39 that are arranged so as to close the third seats or cavities 28*a*, 28*b*, 28*c*, 28*d*, so as to prevent also the exit of the cams from the first seats.

The discs 39 face the adjacent flat surface of the second head 14.

Each one of the cams 29*a*, 29*b*, 29*c*, 29*d* is substantially cylindrical and at least one first hollow 40 is provided, along a generatrix, on their lateral surface, is preferably but not necessarily approximately semicircular in plain view, and is such as to allow the temporary arrangement of the second end 37 and the consequent disengagement of the first ends 32 from the fourth seats 34.

One or more first magnets 41 are associated axially with each one of the cams 29*a*, 29*b*, 29*c*, 29*d*.

Moreover, at least one additional second hollow 42 is provided, along a generatrix, in the lateral surface of each one of the cams 29*a*, 29*b*, 29*c*, 29*d* and differs from the first hollow 40 in that it has a semicircular plan shape that has a smaller diameter and is such as not to allow interaction with the second ends 37 and the consequent engagement of the first ends 32 with the fourth seats 34.

The second recesses 42 thus form false positions for pins 31 in their arrangement at the cams 29*a*, 29*b*, 29*c*, 29*d*; this makes listening and therefore picking by a burglar in practice very difficult to achieve, because of the combination of false positions that can be achieved by varying the number of second recesses 42.

The movement of the pins 31 is allowed thanks to the use of the magnetic key 24, which is placed into the second seat 23: the key imposes on the cams 29*a*, 29*b*, 29*c*, 29*d* such a rotation as to arrange the first recesses 40 of the cams 29*a*, 29*b*, 29*c*, 29*d* in such a position as to face the second ends 37 of the pins 31, thus allowing the pins to move within the through openings 30*a*, 30*b*, 30*c*, 30*d* so as to allow the disengagement of the first ends 32 from the fourth seats 34 of the cylinder 2 upon a rotation imposed thereon.

This rotation of the cylinder is adapted to rotate the lever 17 and therefore allow the opening of the door.

It has thus been found that the invention has achieved the intended aim and objects, a lock of the cam type having been devised which is capable of protecting effectively the lock from tampering attempts.

This solution makes it possible to prevent a burglar from verifying the open condition of the lock simply by listening.

This solution can be easily applied also to ordinary doors of the known type and has the advantage that it is possible to provide cylinders of different dimensions but a single body 18 provided with the magnetic means 19; in this manner, stock reserves and transport and stocking costs by retailers are reduced.

The possibility of coupling and uncoupling the cylinders to and from a single body to 18 allows in fact quick and easy assembly of the desired type of lock.

Since the coupling between the second head 14 of the stem 9 and the body 18 occurs by means of a dovetail connection, it allows the achievement of two advantages: first of all, even if perfect centering between the third stem 26 of the body 18 and the first axial seat 6 of the cylinder 2 does not occur, clearance in the coupling being equal, one avoids interference in the rotation, since the stem 9 can translate.

Secondly, there is an advantage during production, since one has always a same lock in which one can simply change for example the length of the stem 9 and of the cylinder 2.

Obviously, the invention is susceptible of numerous modifications and variations, all of which are within the scope of the appended claims.

Moreover, the number of the third seats or cavities 28*a*, 28*b*, 28*c*, 28*d* may be other than four, and likewise the number of the cams and the pins 31 may vary accordingly.

The number of second hollows 42 also may be reduced or even increased so as to increase the number of false positions of the second ends 37, which, if a burglar operates with an external magnet on said cams, will not allow the sliding of the pins and therefore the rotation of the cylinder.

The placement of the cams 29*a*, 29*b*, 29*c*, 29*d* may also be more pertinent to specific requirements.

Thus, for example, FIGS. 14 to 20 illustrate a further embodiment for magnetic means 119 for the temporary locking of the rotation of the body 118 with respect to the cylinder 102.

In this embodiment, a third cylindrical stem 126 protrudes from the side that is opposite to the front surface 122 of the disc 121 and has, in its surface 127 directed toward the pivot 108, four circular third seats or cavities, designated by the numerals 128, for complementary shaped cams 129*a*, 129*b*, 129*c*, 129*d* that can be associated rotatably therewith, and for discs 139.

Two through openings 130 are provided in the third stem 126 along an axis that passes through the diameter of said surface 127, each through opening being connected to two pairs of the third seats or cavities 128.

A pin 131 is arrangeable within each one of said through openings 130 and has an approximately hemispherical first end 132 directed toward the first head 105 of the cylinder 102.

Such pins 131 are slightly longer than the depth of the respective through openings 130 and have the function of locking temporarily, when they protrude with their first end 132 beyond the perimetric edge 133 of the third stem 126, the rotation of the cylinder 102, since the first ends 132 are arranged temporarily within adapted fourth seats 134 that are provided axially to the internal lateral surface of the first head 105 of the cylinder 102.

Each one of the through openings 130 has an end section, directed away from said cylinder 105, that is narrower and is extended almost up to the center line of the diameter of the third stem 126 so as to form a seat for an elastically deformable element, such as a spring 136 on which a grub 143 acts which is coupled, at the opposite end, to the second end 137 of the pins 131, which has a bilobate shape.

Such springs 136 force the first end 132 of the pins 131 to exit from the through openings 130 in order to allow the first ends 132 to be arranged, when they are in front of them, in the fourth seats 134 of the cylinder 102.

The second end 137 of each one of the pins 131, in the condition in which the first ends 132 are arranged within the fourth seats 134 of the cylinder 102, is completely inserted in one of the through openings 130, interacting with the smooth outer surface of the cams 129*a*, 129*b*, 129*c*, 129*d*.

The second ends 137 may interact selectively with at least one first hollow 140, which is provided in the lateral surface along a generatrix of the cams 129*a*, 129*b*, 129*c*, 129*d*, such hollow 140 having, preferably but not necessarily, an approximately semicircular plan shape and being such as to allow the temporary placement of the second bilobate end 137 simultaneously within two of the hollows 140 of two of the cams 129*a*, 129*b*, 129*c*, 129*d* and the consequent disengagement of the first ends 132 from the fourth seats 134.

Of course, the seats 130 have a convenient length.

One or more first magnets 141 are associated axially with each one of the cams 129*a*, 129*b*, 129*c*, 129*d*.

In this case also, the movement of the pins 131 is allowed by the use of the magnetic key: the key imposes on the cams 129*a*, 129*b*, 129*c*, 129*d* such a rotation as to arrange the first recesses 140 of each pair of cams 129*a*, 129*b*, 129*c*, 129*d* in such a position as to face the second ends 137 of the pins 131, thus allowing the pins to move within the through openings 130 so as to allow the disengagement of said first ends 132 from the fourth seats 134 of the cylinder 102 upon a rotation imposed thereon.

The materials used, as well as the dimensions that constitute the individual components of the invention may of course be more pertinent to the specific requirements.

The various means for performing certain different functions need not certainly coexist only in the illustrated embodiment but can be present per se in many embodiments, including embodiments that are not illustrated.

The characteristics indicated as advantageous, convenient or the like may also be omitted or be replaced with equivalents.

What is claimed is:

1. A lock comprising a cylinder, fixed to a door or door wing, with which a pivot is associated coaxially and rotatably, a lever for closing said door or door wing to a jamb being keyed to the end of said pivot, wherein a separate body can be keyed detachably to a second head of said pivot and is provided with magnetic means for temporary locking of a rotation of said body with respect to said cylinder, wherein said cylinder has a T-shaped configuration in which a first stem has an external thread and a cylindrical first head has a first seat, axially to which a through hole is provided, said pivot being arrangeable rotatably and coaxially with said first seat and at said through hole, said pivot forming a second cylindrical stem, which acts rotatably in said through hole and which, when installed, protrudes with an end thereof beyond a lower surface of said first stem of said cylinder, said second stem being kept rotatably associated, without the possibility of disconnection, with said cylinder by means of an elastic key, which is omega-shaped and can be associated with an annular groove that is provided in said first stem and is adjacent to said end, said second head of said pivot having a flat head that acts rotatably within said first seat, wherein said second head has a circular shape with two recesses obtained along two parallel chords, the separate body being able to be keyed removably at said second head of said pivot and being provided with said magnetic means for the temporary locking of the rotation of said body with respect to said cylinder, and wherein said body is constituted by a disc that has, on a front surface that is directed away from said cylinder, a second seat, which has a square plan shape with rounded corners and within which it is possible to arrange selectively a complementarily shaped magnetic key that contains at least one magnet, grooves being provided in a perimetric edge of said disc and being adapted to constitute grip means for a user, a third cylindrical stem protruding from a side that is opposite to the front surface of said disc and having, in a surface of said third cylindrical stem directed toward said pivot, two or more circular third seats or cavities for complementary shaped cams that can be associated rotatably therewith, and one or more first magnets being associated axially with each one of said complementary shaped cams.

2. The lock according to claim 1, wherein said body can be associated slidingly and detachably with said second head and has, a pair of protrusions, which are crescent-shaped, and protrude so as to be mutually opposite from said front surface and have such dimensions and such an arrangement that the protrusions interact slidingly with said recesses so as to achieve temporary interconnection with said second head, a height of a flat base of said protrusions being substantially equal to a width of said recesses, while a mutual distance between said protrusions is substantially equal to a distance between said recesses.

3. The lock according to claim 2, wherein a coupling between said second head and said body occurs by means of a dovetail connection, with surfaces of said recesses and of said protrusions being inclined.

4. The lock according to claim 1, wherein four through openings are provided in said third stem along chords that pass through a diameter of each one of said third seats or cavities and are connected thereto, and are oriented so as to be arranged, in a clockwise sequence, at right angles to each other and in mutually opposite pairs, each one affecting the diameter of the respective third seat or cavity that is distinct from the one of said third stem, a pin being arrangeable within each one of said through openings and having an approximately hemispherical head, said pins being slightly longer than the depth of the respective through openings and having the function of locking temporarily, when they protrude with a first end thereof beyond a perimetric edge of said third stem, the rotation of said cylinder, since said first ends are arranged temporarily within fourth seats that are provided axially to an internal lateral surface of said cylindrical first head.

5. The lock according to claim 4, wherein each one of said through openings has an end section, directed away from said cylinder, that is narrower, so as to form a discontinuity that is adapted to act as an abutment for an end of an elastically deformable element, which at an opposite end abuts against a base of said first end of said pins, said elastically deformable element forcing the first end of said pins to protrude from said through openings in order to allow said first ends to be arranged in fourth seats of said cylinder, each one of said pins having, at an end opposite to said first end, a second end, which, in a condition in which said first ends are arranged within said fourth seats of said cylinder, is completely inserted in one of said through openings a length of said pins being such that either said first end or said second end protrude from said through openings.

6. The lock according to claim 5, wherein said cams are kept in position by means of central axes or pivots that protrude from the cams and are supported by discs that are arranged so as to close said third seats or cavities, so as to prevent also the exit of said cams from said first seats, said discs facing an adjacent flat surface of said second head, each one of said cams being substantially cylindrical and at least one first hollow being provided, along a generatrix, in a lateral surface, being substantially semicircular, and being such as to allow a temporary arrangement of said second end and a consequent disengagement of said first ends from said fourth seats.

7. The lock according to claim 6, wherein at least one additional second hollow is provided, along a generatrix, in a lateral surface of each one of said cams and has a semicircular plan shape and is such as not to allow interaction with said second ends and a consequent engagement of said first ends with said fourth seats, second recesses of the cams forming false positions for said pins in their arrangement at said cams.

8. The lock according to claim 7, wherein a movement of said pins is allowed by the use of said magnetic key, which is placed in said second seat, said magnetic key imposing on said cams such a rotation as to arrange said first hollows of said cams in such a position as to face said second ends of said pins, thus allowing said pins to move within said through openings so as to allow the disengagement of said first ends from said fourth seats of said cylinder upon a rotation imposed thereon, the rotation of said cylinder allowing said lever to rotate as well.

9. The lock according to claim 1, wherein said cylinder is fixed to a door or door wing by means of an adapted ring that can be associated rotatably with said external thread of said first stem of said cylinder.

10. The lock according to claim 3, wherein said third seats or cavities are arranged with a center at the corners of a polygon.

11. The lock according to claim 10, further comprising four circular third seats or cavities for complementary shaped cams that can be rotatably associated therewith, two through openings being provided in a third stem along an axis that passes substantially through a diameter of said surface of said third cylindrical stem, each said through opening being connected to two pairs of said third seats or cavities, a pin being arrangeable within each one of said through openings.

12. The lock according to claim 11, wherein each one of said through openings has an end section, directed away from said cylinder, that is narrower and is extended almost up to the center line of the diameter of said third stem so as to form a seat for an elastically deformable element on which a grub acts which is coupled, at the opposite end, to a second end of said pins, which has a bilobate shape, said elastically deformed element forcing said first end of said pins to exit from said through openings to allow said first ends to be arranged, when they are in front of them, in said fourth seats of said cylinder.

13. The lock according to claim 12, wherein said second end, in a condition in which said first ends are arranged within said fourth seats of said cylinder, are completely inserted within one of said through openings, interacting with the smooth outer surface of said cams, said second ends interacting selectively with at least one first hollow, which is provided in the lateral surface along a generatrix of said cams, said hollow having a substantially semicircular plan shape and being such as to allow the temporary placement of said second bilobate end simultaneously within two of said hollows of two of said cams and a consequent disengagement of said first ends from said fourth seats.

* * * * *